US011400709B2

(12) United States Patent
Mizuno

(10) Patent No.: US 11,400,709 B2
(45) Date of Patent: Aug. 2, 2022

(54) LIQUID DISCHARGE HEAD

(71) Applicant: BROTHER KOGYO KABUSHIKI KAISHA, Nagoya (JP)

(72) Inventor: Taisuke Mizuno, Yokkaichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/029,546

(22) Filed: Sep. 23, 2020

(65) Prior Publication Data

US 2021/0146685 A1 May 20, 2021

(30) Foreign Application Priority Data

Nov. 19, 2019 (JP) ..... JP2019-208495

(51) Int. Cl.
*B41J 2/14* (2006.01)
*B41J 2/045* (2006.01)

(52) U.S. Cl.
CPC ..... *B41J 2/14* (2013.01); *B41J 2/045* (2013.01)

(58) Field of Classification Search
CPC .... B41J 2/14; B41J 2/045; B41J 2002/14306; B41J 2002/14419; B41J 2002/14459; B41J 2/14233; B41J 2202/12
See application file for complete search history.

(56) References Cited

U.S. PATENT DOCUMENTS

2017/0282544 A1 10/2017 Stephens et al.
2018/0281413 A1* 10/2018 Mizuno ..... B41J 2/161
2019/0084305 A1 3/2019 Sugiura

FOREIGN PATENT DOCUMENTS

JP 2017-185791 A 10/2017
JP 2019-055493 A 4/2019

OTHER PUBLICATIONS

IP.com search (Year: 2021).*

* cited by examiner

*Primary Examiner* — Lisa Solomon
(74) *Attorney, Agent, or Firm* — Merchant & Gould P.C.

(57) ABSTRACT

There is provided a liquid discharge head, including: a channel member that includes a first plate and a second plate and is formed having individual channels and a common channel. The first plate is formed having nozzles. The second plate has a first surface and a second surface at a side opposite to the first surface. The second surface of the second plate is joined to the first plate. The second plate has through holes passing through the second plate from the first surface to the second surface. The second plate is formed having first recesses having ends connected to the through holes. The individual channels include: the nozzles; pressure chambers; descenders defined by the through holes and connecting the nozzles and pressure chambers; and communication channels defined by the first recesses and allowing the descenders to communicate with the common channel. The first recesses are formed in the first surface.

9 Claims, 8 Drawing Sheets

LIQUID DISCHARGE HEAD

CROSS REFERENCE TO RELATED APPLICATION

The present application claims priority from Japanese Patent Application No. 2019-208495 filed on Nov. 19, 2019, the disclosure of which is incorporated herein by reference in its entirety.

BACKGROUND

Field of the Invention

The present disclosure relates to a liquid discharge head including a channel member which includes a plurality of plates and in which a plurality of individual channels is formed.

Description of the Related Art

There is known a channel member including a plurality of plates. In a known channel member, nozzles are opened in a first plate located at the lowest position, and the lower surface of a second plate located at the second lowest position is formed with a recess defining a communicating channel connected to a common channel. The ink flows from the communicating channel to the common channel, thereby the air bubbles can be removed and stagnation of the ink can be prevented.

SUMMARY

Incidentally, in the first plate, generally, from the viewpoint of preventing cracking of the plate or the like, only the nozzle holes are formed, and no grooves or the like for allowing the adhesive to escape are formed. If the communicating channel forming the recessed part (concave part) is formed on the second surface of the second plate as in the above-mentioned known the channel member, the adhesive may penetrate into the recessed part when the first plate and the second plate are bonded to each other. This can result in the communicating channel blockage or the channel area reduction.

It is an object of the present disclosure to provide a liquid discharging head capable of suppressing entry of the adhesive into the communicating channel forming the recessed part.

According to an aspect of the present disclosure, there is provided a liquid discharge head, including: a channel member in which a plurality of individual channels and a common channel are formed. The channel member includes: a first plate including a plurality of nozzles; and a second plate including a first surface and a second surface at a side opposite to the first surface, the second surface being joined to the first plate. The second plate includes a plurality of through holes passing through the second plate from the first surface to the second surface. The second plate includes a plurality of first recesses having ends connected to the through holes. The individual channels include: the nozzles; a plurality of pressure chambers; a plurality of descenders defined by the through holes and connecting the nozzles and pressure chambers; and a plurality of communication channels defined by the first recesses and allowing the descenders to communicate with the common channel. The first recesses are located in the first surface.

DESCRIPTION OF THE EMBODIMENTS

First Embodiment

Figure 1:
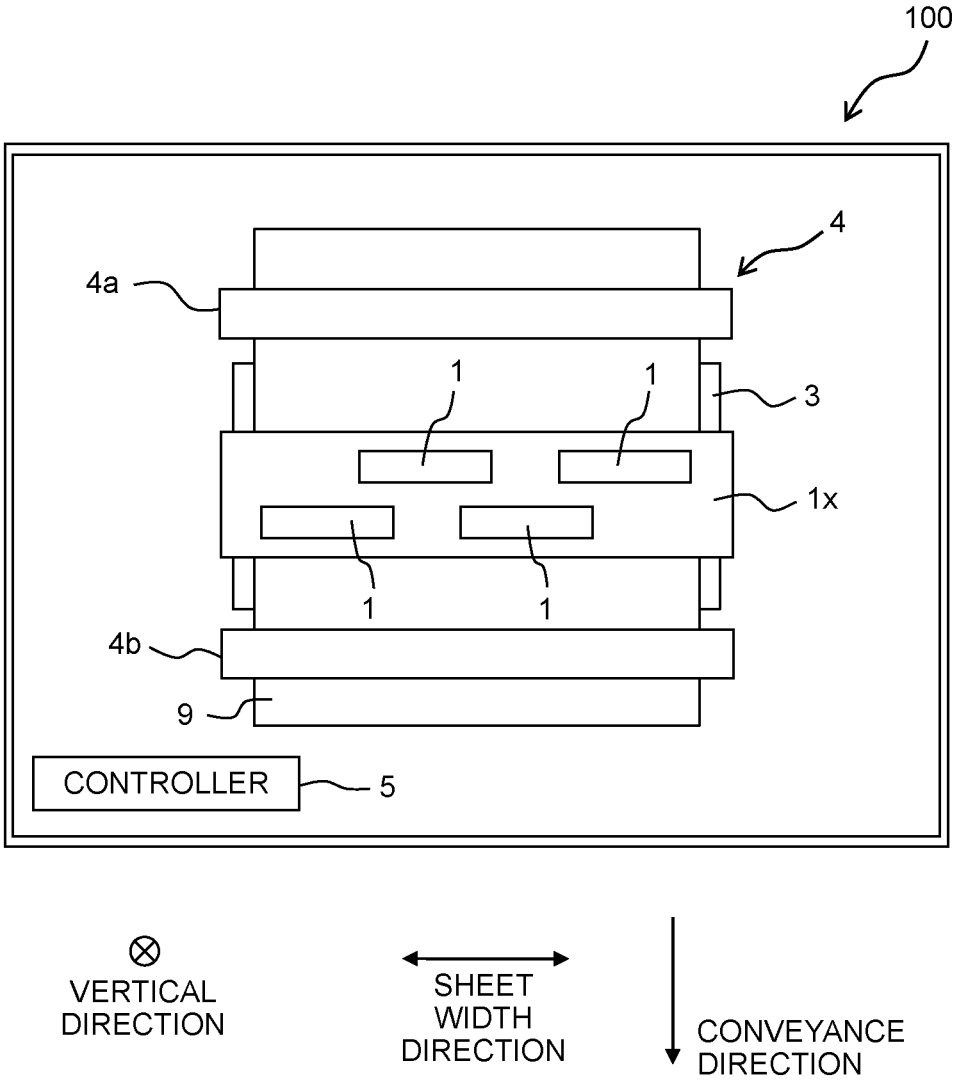
FIG. 1 is a plan view of a printer 100 including a head 1.

Referring to FIG. 1, a schematic configuration of a printer 100 including a head 1 according to the first the embodiment of the present disclosure is described below.

The printer 100 includes a head unit 1*x* including four heads 1, a platen 3, a conveyer 4, and a controller 5.

A sheet 9 is placed on an upper surface of the platen 3.

The conveyer 4 has two roller pairs 4*a* and 4*b* that are disposed to interpose the platen 3 therebetween in a conveyance direction. When a conveying motor (not depicted) is driven by control of the controller 5, the roller pairs 4*a* and 4*b* rotate while nipping the sheet 9, which conveys the sheet 9 in the conveyance direction.

The head unit 1*x* is long in a sheet width direction (a direction perpendicular to the conveyance direction and a vertical direction). The head unit 1*x* is a line-type head unit that discharges ink from a nozzle 21 (see FIG. 2 and FIG. 3) to the sheet 9 with the position of the head unit 1*x* being fixed. Each of the four heads 1 is long in the sheet width direction. The heads 1 are arranged zigzag in the sheet width direction.

The controller 5 includes a Read Only Memory (ROM), a Random Access Memory (RAM), and an Application Specific Integrated Circuit (ASIC). The ASIC executes a recording process and the like in accordance with a program stored in the ROM. In the recording process, the controller 5 controls a driver IC and a conveyance motor (both not depicted) of each head 1 based on a recording instruction (including image data) input from an external apparatus such as a personal computer, and records an image on the sheet 9.

Figure 2:
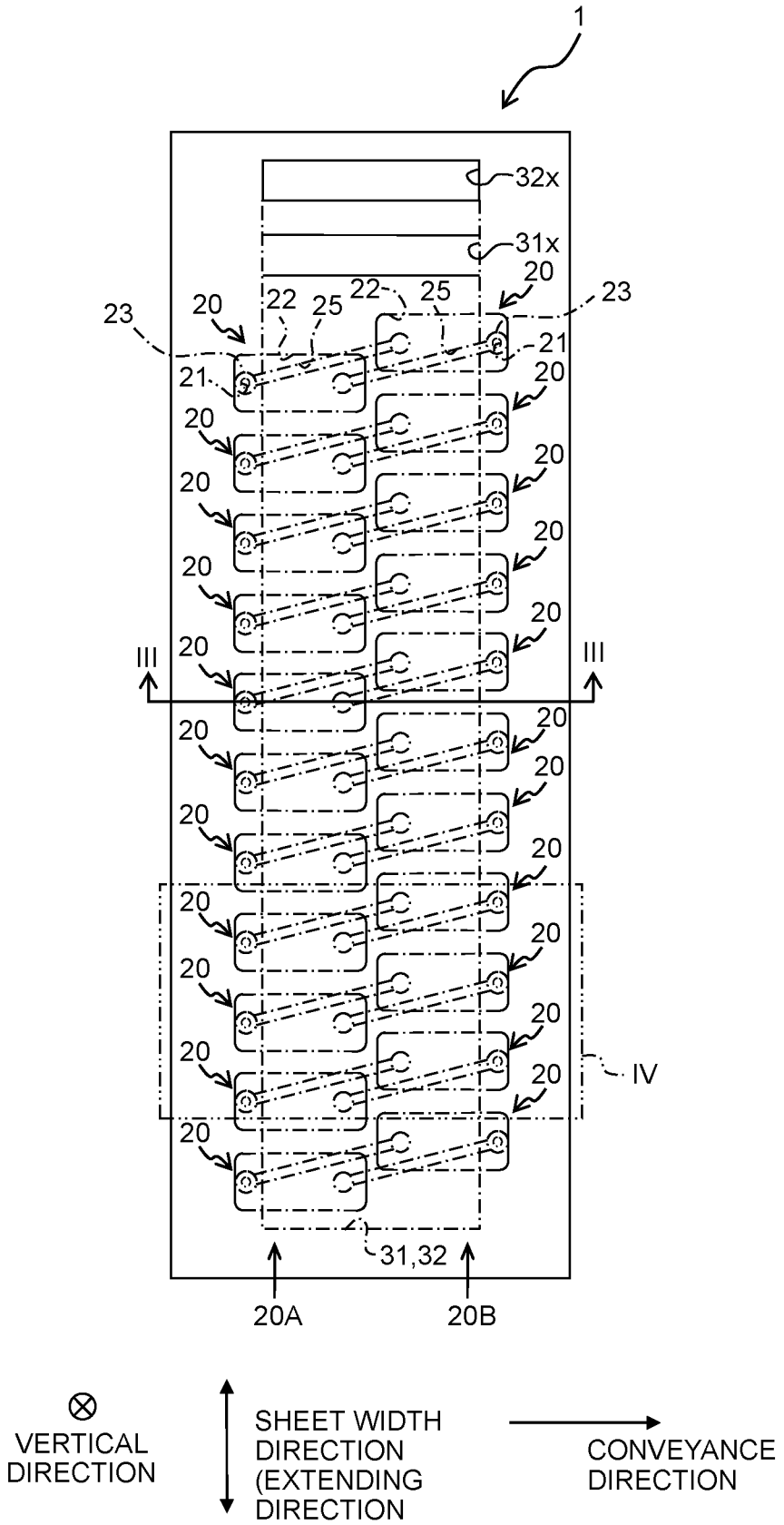
FIG. 2 is a plan view of the head 1.
Figure 3:
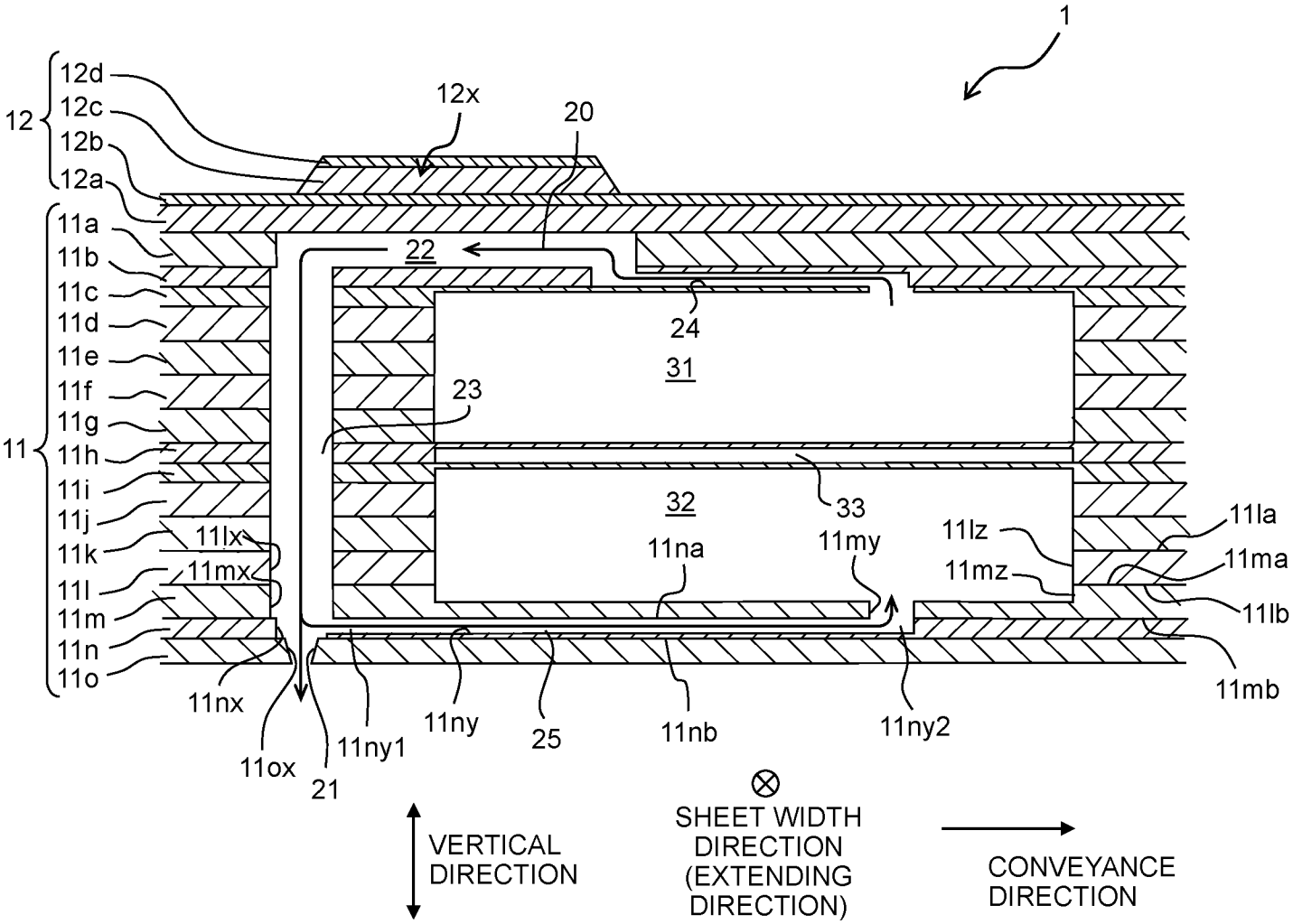
FIG. 3 is a cross-sectional view of the head 1 taken along a line in FIG. 2.

Referring to FIG. 2 to FIG. 4, a configuration of the head 1 is described below.

As depicted in FIG. 3, the head 1 includes a channel member 11 and an actuator substrate 12.

The channel member 11 is formed by fifteen plates 11*a* to 11*o* stacked in the vertical direction and joined to each other. The plates 11*a* to 11 *o* are formed having through holes and recesses that form channels. The channels include individual channels 20, a supply channel 31, and a return channel 32.

As depicted in FIG. 2, the individual channels 20 are arranged zigzag in the sheet width direction (extending direction: a direction in which the supply channel 31 and the return channel 32 extend) to form the first individual channel group 20A and the second individual channel group 20B. Each of the individual channel groups 20A and 20B is formed by the individual channels 20 arranged in the extending direction. The first individual channel group 20A and the second individual channel group 20B are arranged in the conveyance direction.

The return channel 32 corresponds to a "common channel" of the present disclosure. In this embodiment, the supply channel 31 and the return channel 32 are arranged in the vertical direction to overlap with each other in the vertical direction. A length of the supply channel 31 (a length in the extending direction) is substantially the same as a length of the return channel 32. A width of the supply channel 31 (a length in the conveyance direction) is substantially the same as a width of the supply channel 32. A height of the supply channel 31 (a length in the vertical direction) is substantially the same as a height of the return channel 32.

The supply channel 31 communicates with a subtank (not depicted) via a supply port 31*x* provided at the first end (an upper end in FIG. 2) in the extending direction, and the return channel 32 communicates with the subtank via a return port 32*x* provided at the first end (the upper end in FIG. 2) in the extending direction. The second end (a lower end in FIG. 2) in the extending direction of the supply channel 31 is connected to the second end (the lower end in FIG. 2) in the extending direction of the return channel 32.

The subtank communicates with a main tank that stores ink. The subtank stores ink supplied from the main tank. Ink in the subtank flows from the supply port 31*x* to the supply channel 31 by driving a pump (not depicted) through the control of the controller 5. Ink flowing into the supply channel 31 is supplied to the respective individual channels 20 while moving through the supply channel 31 from the first end (the upper end in FIG. 2) toward the second end (the lower end in FIG. 2) in the extending direction. Ink that has reached the second end (the lower end in FIG. 2) in the extending direction of the supply channel 31 and ink that has flowed out of the respective individual channels 20 flow into the return channel 32. Ink flowing into the return channel 32 moves through the return channel 32 from the second end (the lower end in FIG. 2) toward the first end (the upper end in FIG. 2) in the extending direction, and returns to the subtank through the return port 32*x*.

As depicted in FIG. 3, the supply channel 31 is formed by a recess formed in a lower surface of the plate 11*c* and through holes formed in the plates 11*d* to 11*g*. The return channel 32 is formed by a recess (an example of a first recess) formed in a lower surface of the plate 11*i*, through holes formed in the plates 11*j* to 11*l*, and a recess 1*mz* (an example of a second recess) formed in an upper surface 11*ma* of the plate 11*m*. A damper chamber 33 is provided between the supply channel 31 and the return channel 32 in the vertical direction. The damper chamber 33 is formed by a recess formed in a lower surface of the plate 11*h*.

As depicted in FIG. 3, each individual channel 20 includes the nozzle 21, a pressure chamber 22, a descender 23 that connects the nozzle 21 and the pressure chamber 22, an inflow channel 24 that allows the pressure chamber 22 to communicate with the supply channel 31, and an outflow channel 25 that allows the descender 23 to communicate with the return channel 32. Widths of the inflow channel 24 and the outflow channel 25 are smaller than a width of the pressure chamber 22 (the length in the extending direction). The inflow channel 24 and the outflow channel 25 function as throttles. The outflow channel 25 corresponds to a "communication channel" of the present disclosure.

The nozzle 21 is formed by a through hole 11*ox* formed in the plate 11*o*, and the nozzle 21 is opened in a lower surface of the channel member 11. The plate 11*o* corresponds to the "first plate" of the present disclosure, and the through hole 11*ox* corresponds to a "nozzle hole" of the present disclosure.

The pressure chamber 22 is formed by the through hole formed in the plate 11*a*, and the pressure chamber 22 is opened in an upper surface of the channel member 11.

The descender 23 is a cylindrical channel extending downward from the first end in the conveyance direction of the pressure chamber 22. The descender 23 is formed by through holes formed in the plates 11*b* to 11*n*. The nozzle 21 is disposed immediately under the descender 23.

Each pressure chamber 22 belonging to the first individual channel group 20A has a portion overlapping in the vertical direction with the supply channel 31 and the return channel 32 as depicted in FIG. 2 and a portion not overlapping in the vertical direction with the supply channel 31 and the return channel 32 and being positioned upstream of the supply channel 31 and the return channel 32 (a left side in FIG. 2) in the conveyance direction. Each pressure chamber 22 belonging to the second individual channel group 20B has a portion overlapping in the vertical direction with the supply channel 31 and the return channel 32 and a portion not overlapping in the vertical direction with the supply channel 31 and the return channel 32 and being positioned downstream of the supply channel 31 and the return channel 32 (a right side in FIG. 2) in the conveyance direction.

The descenders 23 and the nozzles 21 belonging to the first individual channel group 20A are arranged in the extending direction at the upstream side of the supply channel 31 and the return channel 32 (the left side in FIG. 2) in the conveyance direction. The descenders 23 and the nozzles 21 belonging to the second individual channel group 20B are arranged in the extending direction at the downstream side of the supply channel 31 and the return channel 32 (the right side in FIG. 2) in the conveyance direction. The descenders 23 belonging to the first individual channel group 20A, the return channel 32, and the descenders 23 belonging to the second individual channel group 20B are arranged in the conveyance direction. In the conveyance direction, the return channel 32 is arranged between the descenders 23 belonging to the first individual channel group 20A and the descenders 23 belonging to the second individual channel group 20B.

In each of the individual channel groups 20A and 20B, the individual channels 20 are densely arranged in the extending direction. Each of the pressure chambers 22 belonging to one of the first individual channel group 20A and the second individual channel group 20B has a portion overlapping in the conveyance direction with at least one of the pressure chambers 22 belonging to the other.

As depicted in FIG. 3, the inflow channel 24 has the first end connected to the second end in the conveyance direction of the pressure chamber 22 (the end opposite to the end connected to the descender 23), and the second end connected to the supply channel 31.

As depicted in FIG. 3, the outflow channel 25 has the first end connected to a side surface of a lower end of the descender 23, and the second end connected to a lower surface of the return channel 32.

As depicted in FIG. 2, the outflow channels 25 extend in a direction intersecting with the conveyance direction. The outflow channels 25 belonging to the first individual channel group 20A and the outflow channels 25 belonging to the second individual channel group 20B extend parallel to each other and have portions overlapping with each other in the extending direction.

Although illustration of the inflow channels 24 is omitted in FIG. 2, the inflow channels 24 may extend in the direction intersecting with the conveyance direction, similar to the outflow channels 25. The inflow channels 24 belonging to the first individual channel group 20A and the inflow channels 24 belonging to the second individual channel group 20B may extend parallel to each other and may have portions overlapping with each other in the extending direction.

A line in FIG. 2 is parallel to the conveyance direction. Although the line III-III in FIG. 2 passes through no outflow channel 25, FIG. 3 depicts a space (including the outflow channel 25) of one individual channel 20 belonging to the first individual channel group 20A for the purpose of explanation for the individual channel 20.

As depicted in FIG. 3, the outflow channel 25 is formed by a recess 11*ny* formed in an upper surface 11*na* of the plate 11*n* and a communication hole 11*my* formed in the plate 11*m*.

The plate 11*n* corresponds to "the second plate" of the present disclosure. The plate 11*n* has a top surface (the first surface) 11*na* and a lower surface (the second surface) 11*nb* at the opposite side of the top surface 11*na*. The lower surface 11*nb* of the plate 11*n* is joined to the plate 11*o*. For example, the thickness of plate 11*n* is 50 to 60 μm and the depth of the recess 11*ny* is 30 to 38 μm. The plate 11*n* is formed having not only the recess 11*ny* but also a through hole 11*nx* passing through the plate 11*n* from the upper surface 11*na* to the lower surface 11*nb*. The through hole 11*nx* forms part of the descender 23. The recess 11*ny* has the first end 11*ny*1 connected to the through hole 11*nx*, and the second end 11*ny*2.

Figure 4A:
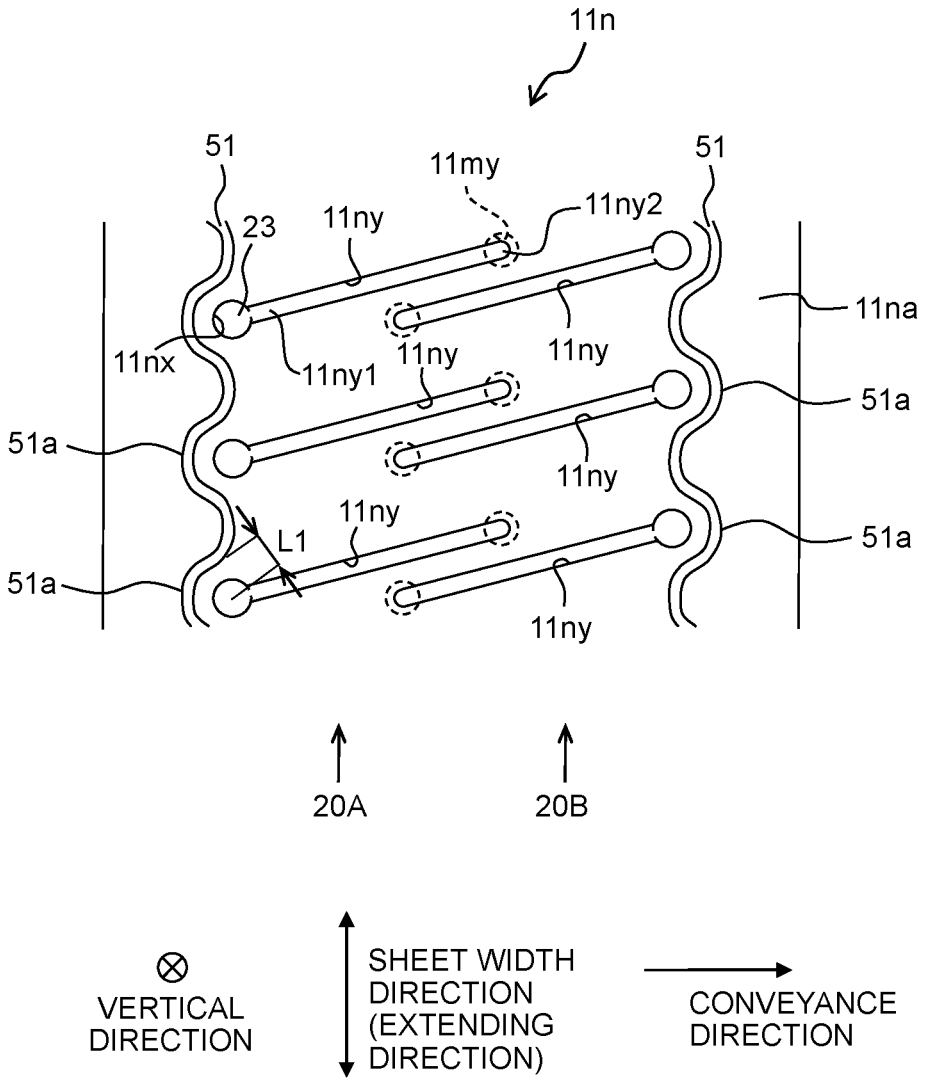
FIG. 4A is an enlarged view of an area IV depicted in FIG. 2 positioned on an upper surface of the second lowermost plate 11*n* of a channel member 11 of the head 1 depicted in FIG. 3.

As depicted in FIG. 4A, the upper surface 11*na* of the plate 11*n* is formed having recesses 11*ny* and grooves 51.

The recesses 11*ny* form two rows arranged in the conveyance direction so that the recesses 11*ny* correspond to the two individual channel groups 20A and 20B. The recesses 11*ny* forming the respective rows are separated from each other in the extending direction so that they are arranged at a regular interval in the extending direction.

The grooves 51 correspond to the "first groove" of the present disclosure. The grooves 51 are disposed around the recesses 11*ny*. In this embodiment, the recesses 11*ny* corresponding to the first individual channel group 20A and the recesses 11*ny* corresponding to the second individual channel group 20B are interposed between the two grooves 51 in the conveyance direction. Each groove 51 extends wavily in the extending direction in an area except for spaces between the recesses 11*ny* adjacent to each other in the extending direction. Each groove 51 has curved portions 51*a*. Each curved portion 51*a* partially surrounds the through hole 11*nx* and the first end 11*ny*1. An interval L1 between the groove 51 and the recess 11*ny* is not less than 0.15 mm and not more than 0.30 mm.

The plate 11*m* corresponds to the "third plate" of the present disclosure. As depicted in FIG. 3, the plate 11*m* has the upper surface 11*ma* (the third surface) and a lower surface 11*mb* (the fourth surface) at the opposite side of the upper surface 11*ma*. The lower surface 11*mb* of the plate 11*m* is joined to the upper surface 11*na* of the plate 11*n*. The lower surface 11*mb* of the plate 11*m* covers the recesses 11*ny* to define the outflow channels 25. The plate 11*m* is formed having not only the communication holes 11*my* and the recess 11*mz* but also through holes 11*mx* passing through the plate 11*m* from the upper surface 11*ma* to the lower surface 11*mb*. The through hole 11*mx* forms part of the descender 23. The through holes 11*mx* overlap in the vertical direction with the through holes 11*nx*.

Figure 4B:
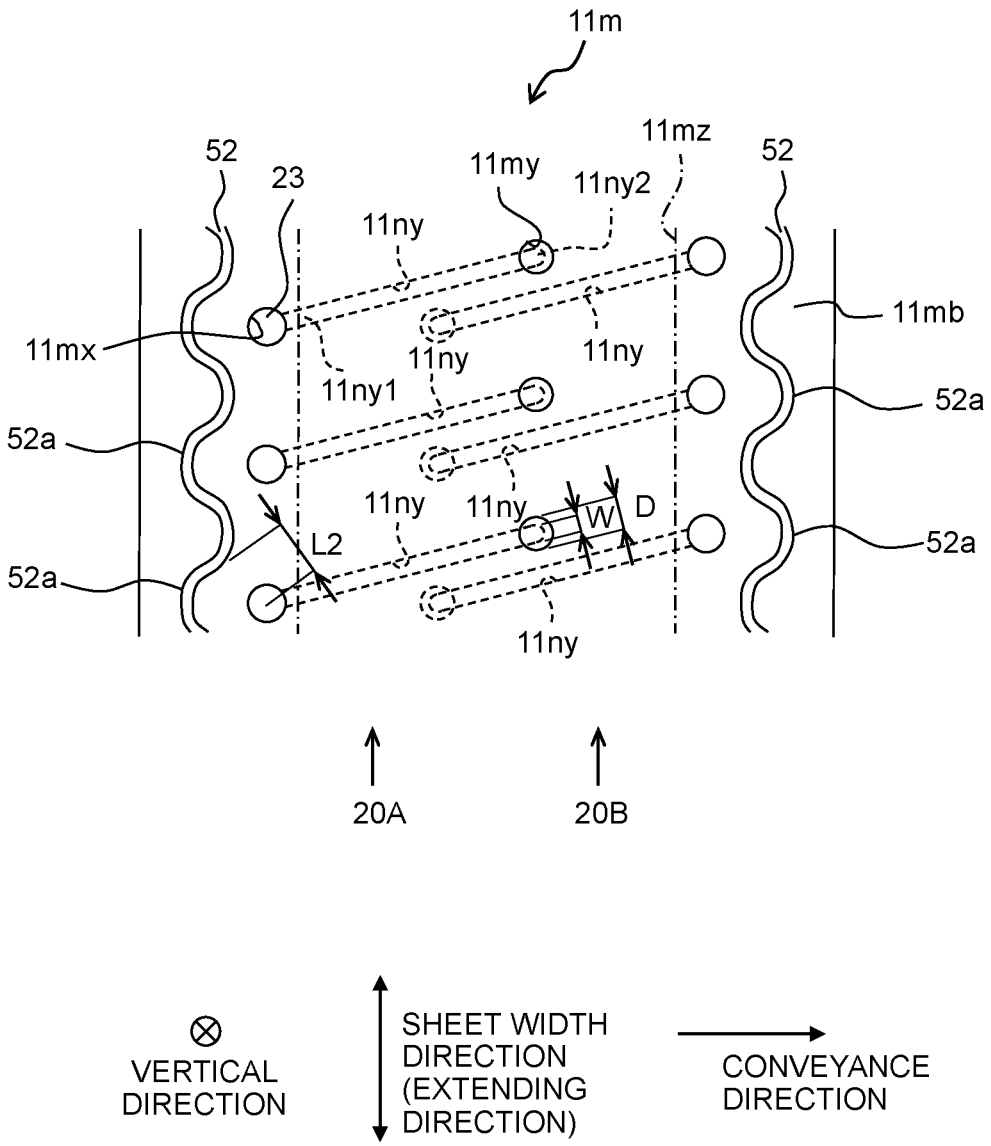
FIG. 4B is an enlarged view of the area IV depicted in FIG. 2 positioned on a lower surface of the third lowermost plate 11*m* of the channel member 11 of the head 1 depicted in FIG. 3.

The communication hole 11*my* passes through the plate 11*m* from a bottom of the recess 11*mz* to the lower surface 11*mb* so that the recess 11*mz* communicates with the second end 11*ny*2 of the recess 11*ny*. As depicted in FIG. 4B, a width W of the second end 11*ny*2 of the recess 11*ny* (a length in an orthogonal direction orthogonal to an extending direction of the recess 11*ny*) is shorter than a diameter D (a length in the orthogonal direction) of the communication hole 11*my*. For example, the width W is 70 to 90 μm, and the diameter D is 100 to 150 μm.

As depicted in FIG. 4B, grooves 52 are formed in the lower surface 11*mb* of the plate 11*m*.

The grooves 52 correspond to the "second groove" of the present disclosure. The grooves 52 are disposed at positions corresponding to the circumferences of the recesses 11*ny*. In this embodiment, the recesses 11*ny* corresponding to the first individual channel group 20A and the recesses 11*ny* corresponding to the second individual channel group 20B are interposed between the two grooves 52 in the conveyance direction. Similar to the grooves 51, each groove 52 extends wavily in the extending direction in an area except for spaces between the recesses 11*ny* adjacent to each other in the extending direction. Each groove 52 has curved portions 52*a*. Each curved portion 52*a* partially surrounds the through hole 11*mx* and the first end 11*ny*1. An interval L2 between the groove 52 and the recess 11*ny* is not less than 0.15 mm and not more than 0.30 mm.

Figure 4C:
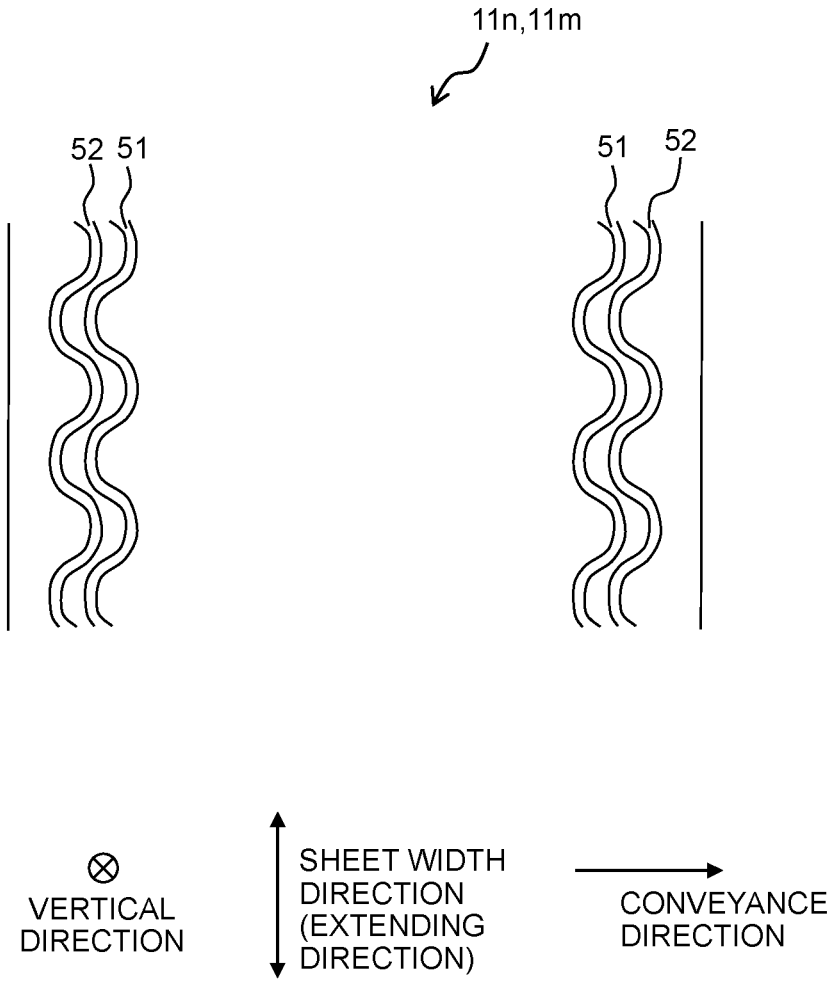
FIG. 4C is a plan view of grooves 51 formed in the plate 11*n* and grooves 52 formed in the plate 11*m*.

As depicted in FIG. 4C, the grooves 51 do not overlap in the vertical direction with the grooves 52.

The plate 11*l* corresponds to the "fourth plate" of the present disclosure. As depicted in FIG. 3, the plate 11*l* has an upper surface (the fifth surface) 11*la* and a lower surface (the sixth surface) 11*lb* at the opposite side of the upper surface 11*la*. The lower surface 11*lb* of the plate 11*l* is joined to the upper surface 11*ma* of the plate 11*m*. The plate 11*l* is formed having through holes 11*lx* each forming part of the descender 23 and a through hole 11*lz* forming part of the return channel 32. The through hole 11*lx* corresponds to a "hole" of the present disclosure. The through holes 11*lx* are opened in the lower surface 11*lb* to overlap in the vertical direction with the recess 11*mz*.

Ink supplied from the supply channel 31 to each individual channel 20 flows into the pressure chamber 22 through the inflow channel 24 as indicated by an arrow in FIG. 3, moves substantially horizontally in the pressure chamber 22, and flows into the descender 23. Ink flowing into the descender 23 moves downward through the descender 23, and part of which is discharged from the nozzle 21 and the rest of which flows into return channel 32 through the outflow channel 25.

The discharge of air bubbles and the increase in viscosity of ink in the supply channel 31 and the return channel 32 formed in the channel member 11 as well as in each individual channel 20 are achieved by circulating ink between the subtank and the channel member 11.

The actuator substrate 12 includes, in order from below, a vibration plate 12*a*, a common electrode 12*b*, piezoelectric bodies 12*c*, and individual electrodes 12*d*.

The vibration plate 12*a* and the common electrode 12*b* are disposed on the upper surface of the channel member 11 (an upper surface of the plate 11*a*). The vibration plate 12*a* and the common electrode 12*b* cover all the pressure chambers 22 formed in the plate 11*a*. The piezoelectric bodies 12*c* and the individual electrodes 12*d* are provided for the respective pressure chambers 22 so that they overlap in the vertical direction with the respective pressure chambers 22.

The common electrode 12*b* and the individual electrodes 12*d* are electrically connected to the driver IC (not depicted). The driver IC changes the potential of the individual electrode 12*d* while maintaining the potential of the common electrode 12*b* at the ground potential. Specifically, the driver IC generates a driving signal based on a control signal from the controller 5, and applies the driving signal to the individual electrode 12*d*. This changes the potential of the individual electrode 12*d* between a predetermined driving potential and the ground potential. In this situation, part (actuator 12*x*) of the vibration plate 12*a* and the piezoelectric body 12*c* interposed between the individual electrode 12*d* and the pressure chamber 22 is deformed to be convex toward the pressure chamber 22, thereby changing the volume of the pressure chamber 22 and applying pressure to ink in the pressure chamber 22. Accordingly, ink is discharged from the nozzle 21. The actuator substrate 12 has actuators 12*x* corresponding to the pressure chambers 22.

As described above, according to this embodiment, the recesses 11*ny* forming the outflow channels 25 are not formed in the lower surface 11*nb* but in the upper surface 11*na* of the plate 11*n* (see FIG. 3). The plate 11*o* is typically formed having only the through holes 11*ox* that form the nozzles 21 in order to inhibit cracking of the plate and the like. No relief groove for adhesive is formed in the plate 11*o*. The relief groove(s) for adhesive is/are more easily formed in any other plates than the plate 11*o* (plate 11*n*, plate 11*m*, and the like) in view of a material of the plate and the like. Thus, the recesses 11*ny* are formed in the upper surface 11*na* of the plate 11*n* in this embodiment. In this case, since the relief grooves for adhesive (grooves 51 in FIG. 4A and grooves 52 in FIG. 4B) are easily formed in the upper surface 11*na* of the plate 11*n* and the lower surface 11*mb* of the plate 11*m*, adhesive is not likely to invade into the recesses 11*ny* at the time of joining the plate 11*m* and the plate 11*n*. This inhibits adhesive from invading into the recesses 11*ny* forming the outflow channels 25.

The grooves 51 are formed to be located around the recesses 11*ny* in the upper surface 11*na* of the plate 11*n* (see FIG. 4A). This allows adhesive to escape via the grooves 51, thereby reliably inhibiting adhesive from invading into the recesses 11*ny*.

The grooves 52 are formed to be located around the recesses 11*ny* in the lower surface 11*mb* of the plate 11*m* (see FIG. 4B). This allows adhesive to escape via the grooves 52, thereby reliably inhibiting adhesive from invading into the recesses 11*ny*.

At least part of the groove 51 (each curved portion 51*a* in the above embodiment) partially surrounds the first end 11*ny*1 of the recess 11*ny* (see FIG. 4A). At least part of the groove 52 (each curved portion 52*a* in the above embodiment) partially surrounds the first end 11*ny*1 of the recess 11*ny* (see FIG. 4B). This allows an outer edge of the first end 11*ny*1 of the recess 11*ny* to gain the effect of the grooves 51, 52 (the effect of inhibiting adhesive from invading into the recesses 11*ny*).

The grooves 51 are 52 are in areas except for spaces between the recesses 11*ny* adjacent to each other in the extending direction (see FIGS. 4A and 4B). When there are grooves between the recesses 11*ny* adjacent to each other in the extending direction, adhesion failure may be caused in the areas between the recesses 11*ny*. The configuration of this embodiment inhibits this problem.

The interval L1 between the groove 51 and the recess 11*ny* is not less than 0.15 mm and not more than 0.30 mm. The interval L2 between the groove 52 and the recess 11*ny* is not less than 0.15 mm and not more than 0.30 mm. When the intervals L1 and L2 are smaller than the above (e.g., less than 0.15 mm), adhesion failure (poor adhesion) around the recesses 11*ny* and the invasion of adhesive into the recesses 11*ny* are likely to occur. Further, when the intervals L1 and L2 are larger than the above (e.g., not less than 0.30 mm), it is difficult to obtain the effect of the grooves 51 and 52 (effect of inhibiting adhesive from invading into the recesses 11*ny*). The configuration of this embodiment inhibits those problems.

The plates 11*n* and 11*m* are respectively formed having the grooves 51 and 52 (see FIGS. 4A and 4B), and the grooves 51 do not overlap in the vertical direction with the grooves 52 (see FIG. 4C). In this case, the effect of releasing the adhesive is enhanced by forming the grooves in the plates 11*n* and 11*m*, thus further inhibiting adhesive from invading into the recesses 11*ny*. Since the grooves 51 do not overlap in the vertical direction with the grooves 52, the effect of the grooves 51 and 52 (effect of inhibiting adhesive from invading into the recesses 11*ny*) can be obtained over a wider range.

The plate 11*m* is formed having the recess 11*mz* forming the return channel 32 and the communication holes 11*my* that allow the recess 11*mz* to communicate with the second ends 11*ny*2 of the recesses 11*ny* (see FIG. 3). The volume of the return channel 32 is larger than a case where no recess 11*mz* is formed in the plate 11*m* and a through hole that allows the through hole 11*lz* of the plate 11*l* to communicate with the second ends 11*ny*2 of the recesses 11*ny* is formed. The configuration of this embodiment reduces a channel resistance of the return channel 32, thus facilitating the discharge of air bubbles.

The width W of the second end 11*ny*2 of the recess 11*ny* (the length in the orthogonal direction orthogonal to the extending direction of the recess 11*ny*) is shorter than the diameter D of the communication hole 11*my* (the length in the orthogonal direction) (see FIG. 4B). When a positional shift in the orthogonal direction is caused at the time of joining the plate 11*m* and the plate 11*n*, a wall defining the communication hole 11*my* of the plate 11*m* is liable to overlap with the second end 11*ny*2 of the recess 11*ny* of the plate 11*n*. This may inhibit the flowing of ink from the second end 11*ny*2 to the communication hole 11*my*, thus inhibiting the discharge of air bubbles. The configuration of this embodiment inhibits this problem.

Second Embodiment

Figure 5:
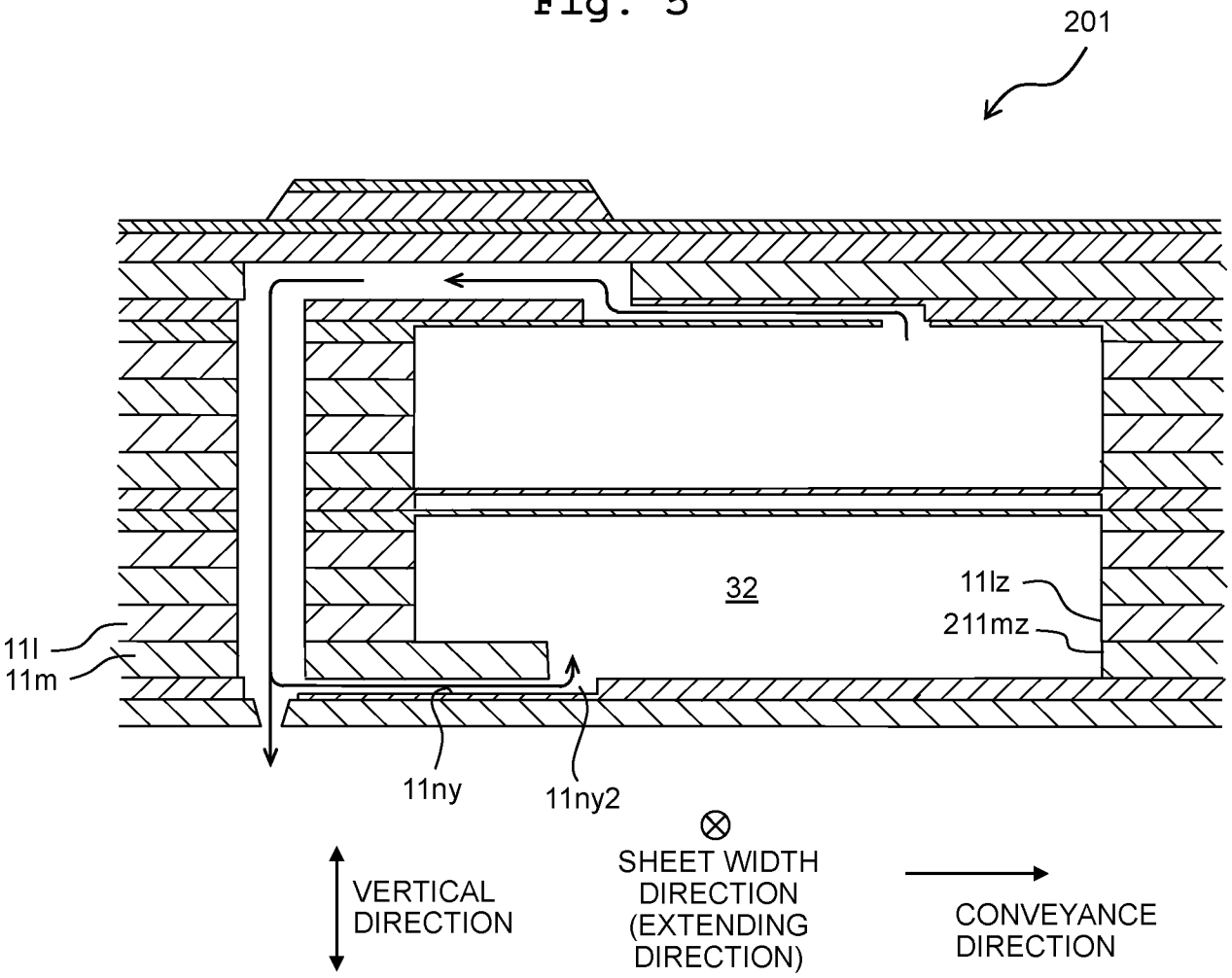
FIG. 5 is a cross-sectional view of a head 201 corresponding to FIG. 3.

Referring to FIG. 5, a head 201 according to the second embodiment of the present disclosure is explained below.

In the first embodiment (FIG. 3), the plate 11*m* is formed having the recess 11*mz* forming the return channel 32 and the communication holes 11*my* that allow the recess 11*mz* to communicate with the second ends 11*ny*2 of the recesses 11*ny*. In this embodiment (FIG. 5), the plate 11*m* is formed having a through hole 211*mz* forming the return channel 32, and the second ends 11*ny*2 of the recesses 11*ny* are connected to an end of the through hole 211*mz*. An inner diameter of the through hole 211*mz* is smaller than an inner diameter of the through hole 111*z* formed in the plate 11*l*.

Although the configuration(s) of the return channel 32 and the like according to the second embodiment is different from the first embodiment, effects similar to the first embodiment can be obtained by the configuration(s) similar to the first embodiment.

Third Embodiment

Figure 6:
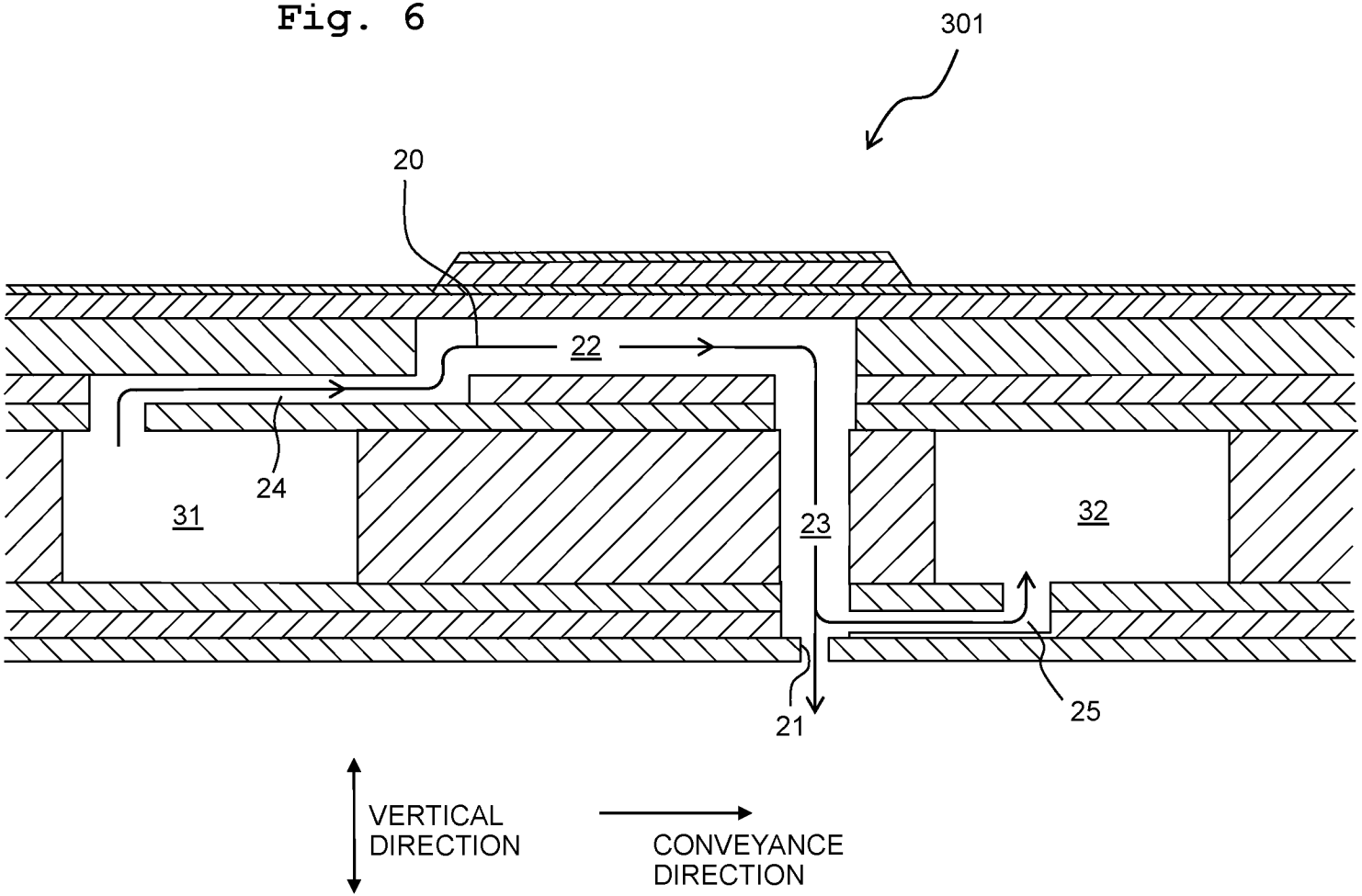
FIG. 6 is a cross-sectional view of a head 301 corresponding to FIG. 3.

Referring to FIG. 6, a head 301 according to the third embodiment of the present disclosure is explained.

In the first embodiment (FIG. 3), the supply channel 31 and the return channel 32 are arranged in the vertical direction. In this embodiment (FIG. 6), the supply channel 31 and the return channel 32 are arranged in the conveyance direction.

In each individual channel 20 of the third embodiment, the nozzle 21, the pressure chamber 22, and the descender 23 are arranged between the supply channel 31 and the return channel 32 in the conveyance direction. With respect to the pressure chamber 22, the inflow channel 24 extends toward the upstream side in the conveyance direction and the outflow channel 25 extends toward the downstream side in the conveyance direction.

Although the configurations of the supply channel 31 and the return channel 32 and the like according to the third embodiment are different from the first embodiment, effects similar to the first embodiment can be obtained by the configuration(s) similar to the first embodiment.

Modified Embodiments

The embodiments of the present disclosure are explained above. The present disclosure, however, is not limited to the above embodiments. Various changes or modifications may be made without departing from the claims.

In the above embodiment (FIG. 2), the two individual channel groups 20A and 20B are provided for one common channel (returning channel 32). The present disclosure, however, is not limited thereto. For example, only one individual channel group 20A may be provided for one common channel (returning channel 32).

In the above embodiment (see FIG. 2), the recess extends obliquely (direction intersecting with both the extending direction and the direction (conveyance direction) orthogonal to the extending direction). The present disclosure, however, is not limited thereto. The recess may extend in a direction orthogonal to the extending direction.

In the above embodiment (see FIG. 4C), the grooves formed in the second and third plates do not overlap with each other in a direction orthogonal to the first surface. The present disclosure, however, is not limited thereto. The grooves may overlap with each other in the above direction.

In the above embodiment (see FIG. 4A), the recesses 11*ny* corresponding to the first individual channel group 20A and the recesses 11*ny* corresponding to the second individual channel group 20B are interposed between the two grooves 51 in the conveyance direction. The present disclosure, however, is not limited thereto. For example, the two grooves 51 may be arranged between the recesses 11*ny* corresponding to the first individual channel group 20A and the recesses 11*ny* corresponding to the second individual channel group 20B in the conveyance direction. Similarly, in the above embodiment (see FIG. 4B), the recesses 11*ny* corresponding to the first individual channel group 20A and the recesses 11*ny* corresponding to the second individual channel group 20B are interposed between the two grooves 52 in the conveyance direction. The present disclosure, however, is not limited thereto. For example, the two grooves 52 may be arranged between the recesses 11*ny* corresponding to the first individual channel group 20A and the recesses 11*ny* corresponding to the second individual channel group 20B in the conveyance direction.

The grooves may be arranged between the recesses adjacent to each other in the extending direction. The grooves may not include the curved portions (see FIGS. 4A to 4C) but include V-shaped bent portions (the entirety of the groove may have a zigzag shape).

In the above embodiment (see FIGS. 4A and 4B), at least parts of the grooves 51 and 52 partially surround the first ends 11*ny*1 of the recesses. The present disclosure, however, is not limited thereto. At least parts of the grooves 51 and 52 may partially surround the second ends 11*ny*2 of the recesses or may partially surround the first ends 11*ny*1 and the second ends 11*ny*2 of the recesses.

The grooves may not partially surround the first ends and/or the second ends of the recesses. For example, the grooves may extend linearly instead of extending wavily or zigzag in the extending direction. The grooves may extend in a direction (conveyance direction) orthogonal to the extending direction instead of extending in the extending direction.

In the above embodiment (see FIGS. 4A and 4B), the grooves are formed in the second plate and the third plate. The present disclosure, however, is not limited thereto. The grooves may be formed in only one of the second plate and the third plate. Alternatively, no grooves may be formed in the second plate and the third plate.

In the above embodiment (see FIG. 3), the through hole 11*lz* is formed as the "hole" formed in the fourth plate. The present disclosure, however, is not limited thereto. For example, the "hole" may be a recess formed in the sixth surface (lower surface 11*lb*) of the fourth plate.

The supply channel is not limited to being formed in the channel member. The supply channel may be formed in any other member than the channel member.

The liquid discharge head is not limited to the line-type head. The liquid discharge head may be a serial type head in which liquid is discharged from nozzles on a medium (an object to which liquid is to be discharged) during its movement in a scanning direction parallel to the sheet width direction.

The medium is not limited to the sheet or paper, and may be a cloth, a substrate, and the like.

The liquid discharged from the nozzles is not limited to the ink, and may be any liquid (e.g., a treatment liquid that agglutinates or precipitates constituents of ink).

The present disclosure is applicable to facsimiles, copy machines, multifunction peripherals, and the like without limited to printers. The present disclosure is also applicable to a liquid discharge apparatus used for any other application than the image recording (e.g., a liquid discharge apparatus that forms an electroconductive pattern by discharging an electroconductive liquid on a substrate).

What is claimed is:

1. A liquid discharge head, comprising:

a channel member in which a plurality of individual channels and a common channel are formed, the channel member including:

a first plate including a plurality of nozzles; and a second plate including a first surface and a second surface at a side opposite to the first surface, the second surface being joined to the first plate, wherein the second plate includes a plurality of through holes passing through the second plate from the first surface to the second surface, wherein the second plate includes a plurality of first recesses having ends connected to the through holes, wherein the individual channels include:

the nozzles;

a plurality of pressure chambers;

a plurality of descenders defined by the through holes and connecting the nozzles and pressure chambers; and a plurality of communication channels defined by the first recesses, one end of the communication channels being connected to the common channel, and the other end of the communication channels being connected to the descenders, and wherein the first recesses are located in the first surface.

2. The liquid discharge head according to claim 1, wherein the second plate includes a groove located around the first recesses in the first surface.

3. The liquid discharge head according to claim 1, wherein the channel member further includes a third plate including a third surface and a fourth surface at a side opposite to the third surface, the fourth surface of the third plate being joined to the first surface of the second plate, and the fourth surface covering the first recesses to define the communication channels, and wherein the third plate includes a groove located around the first recesses in the fourth surface.

4. The liquid discharge head according to claim 2, wherein the groove partially surrounds at least one of the ends and the other ends of the first recesses.

5. The liquid discharge head according to claim 2, wherein the first recesses are apart from each other in an extending direction of the common channel, and wherein the groove is in an area except for a space between the first recesses that are adjacent to each other in the extending direction.

6. The liquid discharge head according to claim 2, wherein an interval between the groove and the first recesses is not less than 0.15 mm and not more than 0.30 mm.

7. The liquid discharge head according to claim 1, wherein the channel member further includes a third plate including a third surface and a fourth surface at a side opposite to the third surface, the fourth surface of the third plate being joined to the first surface of the second plate, and the fourth surface covering the first recesses to define the communication channels, wherein the second plate includes a first groove located around the first recesses in the first surface, wherein the third plate includes a second groove located around the first recesses in the fourth surface, and wherein the first groove does not overlap with the second groove in a direction orthogonal to the first surface.

8. The liquid discharge head according to claim 1, wherein the channel member further includes a third plate and a fourth plate, the third plate including a third surface and a fourth surface at a side opposite to the third surface, the fourth surface of the third plate being secured to the first surface of the second plate, the fourth surface covering the first recesses to define the communication channels, the fourth plate including a fifth surface and a sixth surface at a side opposite to the sixth surface, the sixth surface of the fourth plate being secured to the third surface of the third plate, and the fourth plate including a hole that is opened in the sixth surface to form the common channel, wherein the third plate includes a second recess and a plurality of communication holes, wherein the third plate includes the second recess located in the third surface, wherein the second recess overlaps with the hole in a direction orthogonal to the third surface to form the common channel, wherein the communication holes pass through the third plate from a bottom of the second recess to the fourth surface, and wherein the communication holes allow the second recess to communicate with the other ends of the first recesses and forms the communication channels.

9. The liquid discharge head according to claim 8, wherein a length in an orthogonal direction, which is orthogonal to an extending direction of the first recesses, of the other ends of the first recesses is shorter than a length in the orthogonal direction of the communication holes.

* * * * *